United States Patent [19]

Artiano

[11] Patent Number: 5,012,933

[45] Date of Patent: May 7, 1991

[54] MACHINE AND METHOD FOR SORTING OUT OVER-THICK WOOD CHIPS

[75] Inventor: Adrian Artiano, Mukilteo, Wash.

[73] Assignee: Acrowood Corporation, Everett, Wash.

[21] Appl. No.: 296,756

[22] Filed: Jan. 17, 1989

Related U.S. Application Data

[63] Continuation-in-part of Ser. No. 155,270, Feb. 12, 1988, Pat. No. 4,903,845.

[51] Int. Cl.[5] ..... B07B 13/07

[52] U.S. Cl. ..... 209/671; 209/673

[58] Field of Search ..... 209/632, 667, 668, 669, 209/670, 671, 673

[56] References Cited

U.S. PATENT DOCUMENTS

| | | | |
|---|---|---|---|
| 1,647,816 | 11/1927 | Riddell . | |
| 1,899,292 | 2/1933 | Rienks . | |
| 2,370,539 | 2/1945 | Hodecker | 209/668 |
| 2,786,574 | 3/1957 | Clark . | |
| 3,817,375 | 6/1974 | Herkes | 209/673 |
| 3,848,741 | 11/1974 | Haley et al. . | |
| 4,209,097 | 6/1980 | Nordmark et al. . | |
| 4,452,694 | 6/1984 | Christensen et al. | 209/667 X |
| 4,600,106 | 7/1986 | Minardi . | |
| 4,903,845 | 2/1990 | Artiano | 209/671 |

FOREIGN PATENT DOCUMENTS

| | | | |
|---|---|---|---|
| 574292 | 4/1959 | Canada | 209/669 |
| 3027651 | 3/1982 | Fed. Rep. of Germany . | |
| 1227263 | 4/1986 | U.S.S.R. . | |
| 01580 | 3/1986 | World Int. Prop. O. | 209/667 |

*Primary Examiner*—Joseph E. Valenza

*Attorney, Agent, or Firm*—Seed and Berry

[57] ABSTRACT

Wood chips having an acceptable thickness pass between the rollers of a roller screen for collection and over-thick chips discharge from one end of the roller screen for recycling. The rollers have chip agitating protuberances, preferably of pyramidal shape or in the form of spiral ridges. A second roller screen with pyramidal protuberances on its rollers and with its rollers closer together is used to screen out fines, preferably after the fines and acceptable chips pass through the first roller screen. Some of the fines pass through the second roller screen by occupying the valleys between the pyramidal protuberances.

18 Claims, 5 Drawing Sheets

FIG. 9
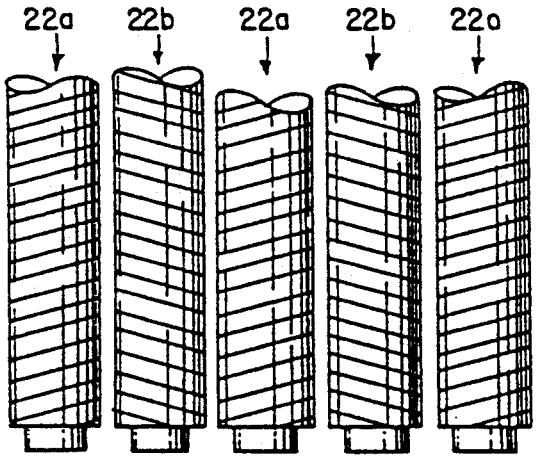
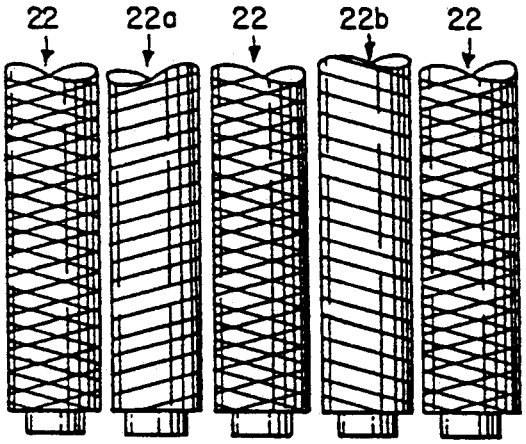
FIG. 10
FIG. 11
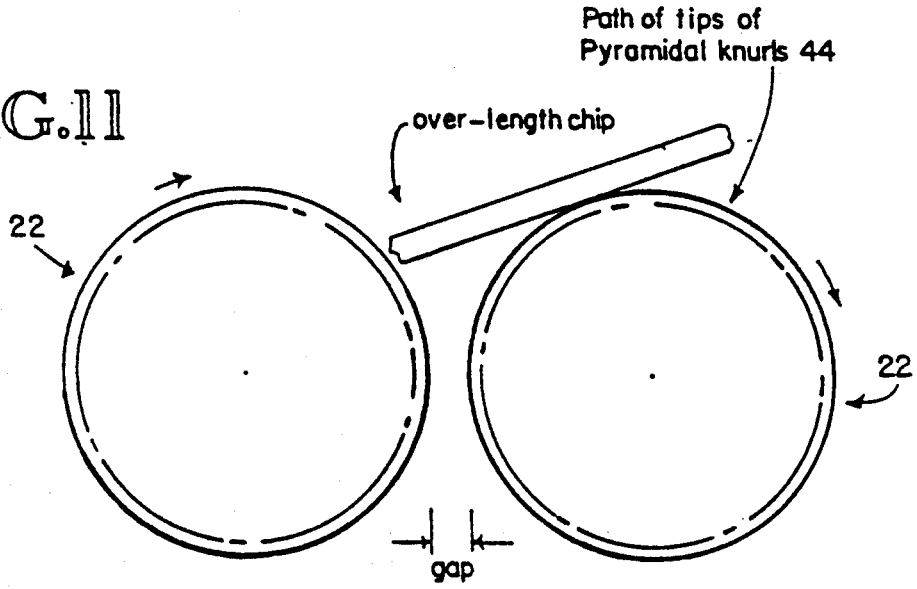

MACHINE AND METHOD FOR SORTING OUT OVER-THICK WOOD CHIPS

CROSS-REFERENCE TO RELATED APPLICATION

This application is a continuation-in-part of my copending application Ser. No. 155,270, filed Feb. 12, 1988, now U.S. Pat. No. 4,903,845, issued Feb. 27, 1990.

TECHNICAL FIELD

The present invention relates to the sorting of materials such as wood chips, and more particularly, to a machine and method for removal of over-thick chips not suitable for the ultimate use of the material.

BACKGROUND ART

In the processing of wood chips preparatory to introduction to a digester, it is preferred to reprocess chips which are thicker than a predetermined thickness and to discard those chip particles which have fibers shorter than a preset minimum length or which are in the form of flakes thinner than a preset thickness, because these are considered to be poor digesting materials. For purposes of the present description, the chips to be reprocessed will be called "over-thick" and the undesired chip particles and flakes will be called "fines."

Chips in excess of 8 mm in thickness tend to remain crude after cooking in the digester, and therefore require after-treatment. Accordingly, it is important to screen out the over-thick chips from the pulp chip supply. The difficulty in accomplishing such screening is compounded by the fact that the chips normally vary in length from about 20 to 30 mm and in width from about 15 to 20 mm. Thus, the thickness of the chips is usually considerably smaller than the other dimensions.

The traditional screening apparatus for pulp chips have been (a) sloped, vibratory holed screens given an oscillating or circular motion commonly in the range of 2 to 3 inches, at a relatively high speed to shift the properly sized chips through the holes in the screen, and (b) disk screens such, for example, as shown in U.S. Pat. No. 4,301,930, which comprises a bed of parallel, corotating shafts carrying interdigitated disks having a clearance defined by the maximum chip thickness to be tolerated.

Disk screens have been considered by many in the cellulose industry as superior to vibratory screens, but as indicated in U.S. Pat. No. 4,660,726, disk screens have a relatively low screening capacity per square meter of screening surface, and, as indicated in U.S. Pat. No. 4,538,734, it is very difficult to attain and maintain uniform slot widths between the disks of a disk screen, particularly when the slot widths are required to be so narrow. As a consequence there have been efforts to provide improved techniques for mounting and replacing the disks of disk screens and attempts to develop a suitable alternative to disk screens. Such attempts have included oscillating bar screens, such as shown in U.S. Pat. No. 4,660,726 and synchronously driven, intermeshing screw spirals, such as disclosed in U.S. Pat. No. 4,430,210.

DISCLOSURE OF THE INVENTION

Although roll screens or grizzlies have long been used for sizing or separating various products, they have not been considered as suitable for removing over-thick chips or fines from wood chip material. Nor have they been considered as suitable for removing chips classified as normally "over-length." In the past it was not recognized that roll screens could be used successfully for sorting functions with respect to wood chips if the surface of the rollers was such as to adequately agitate the chips and assist the conveying action of the rollers.

In carrying out the invention, there is utilized a plurality of side-by-side, transversely spaced rollers which collectively provide a bed for receiving the wood chips to be sorted and have their surface provided with chip-agitating protuberances. These protuberances may be knurls or ridges, and the rollers are rotated in the same direction so that the protuberances function to tumble and push the chips along the bed.

The gaps between rollers are sized to receive only the chips of proper thickness ("acceptable chips"). As the rollers rotate, the acceptable chips occupying the spaces between the rollers above the sizing gaps pass downwardly through the gaps into a hopper or onto a discharge conveyor. The over-thick chips in the spaces between the rollers are nudged ahead by the oncoming chips and continue to be conveyed along the roller bed by the rollers for discharge from the forward end of the roller bed for reprocessing. When the protuberances on the rollers are knurls, they are preferably pyramidal, and when the protuberances are ridged, the ridges are preferably tapered and helical for the length of the rollers (the width of the bed). When pyramidal protuberances are used, they preferably are formed by two helical sets of routed V-grooves of opposite hand, and when the protuberances are ridges they are preferably formed by a single helical set of routed V-grooves.

It is preferred that all of the rollers be of the form with pyramidal protuberances. If all of the protuberances are helical ridges, then the helical patterns of adjacent rollers should be of opposite hand. The bed can also be formed by rollers with knurls alternating with rollers having ridges, in which case it is preferred that the hands of the helical patterns of the ridged rollers be alternated when placed on opposite sides of a knurled roller.

Typical rollers can have, for example, a diameter of 3½ inches, a protuberance depth of 0.1 inch, a protuberance width and spacing of 0.25 inch, and a helix angle of 27 degrees.

BRIEF DESCRIPTION OF THE DRAWINGS

FIG. 9 is a fragmentary plan view showing an arrangement of the second embodiment of rollers.

FIG. 10 is a fragmentary plan view showing an alternative arrangement combining use of the first and second embodiment of rollers.

FIG. 11 shows the action of the rollers with respect to an over-length chip when viewed from one end of the rollers.

BEST MODE FOR CARRYING OUT THE INVENTION

Figure 1:
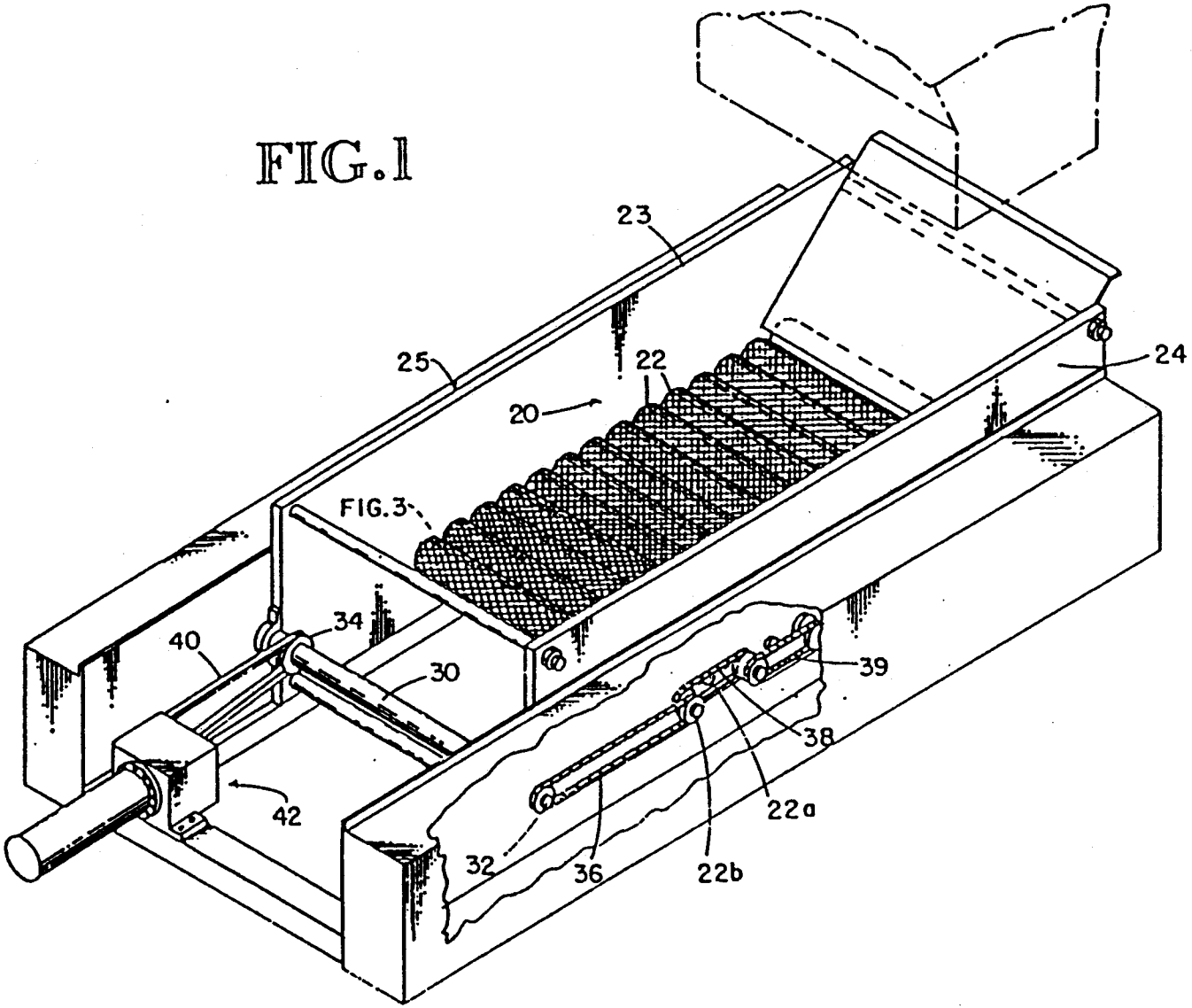
FIG. 1 is a top perspective of a machine embodying the present invention.
Figure 2:
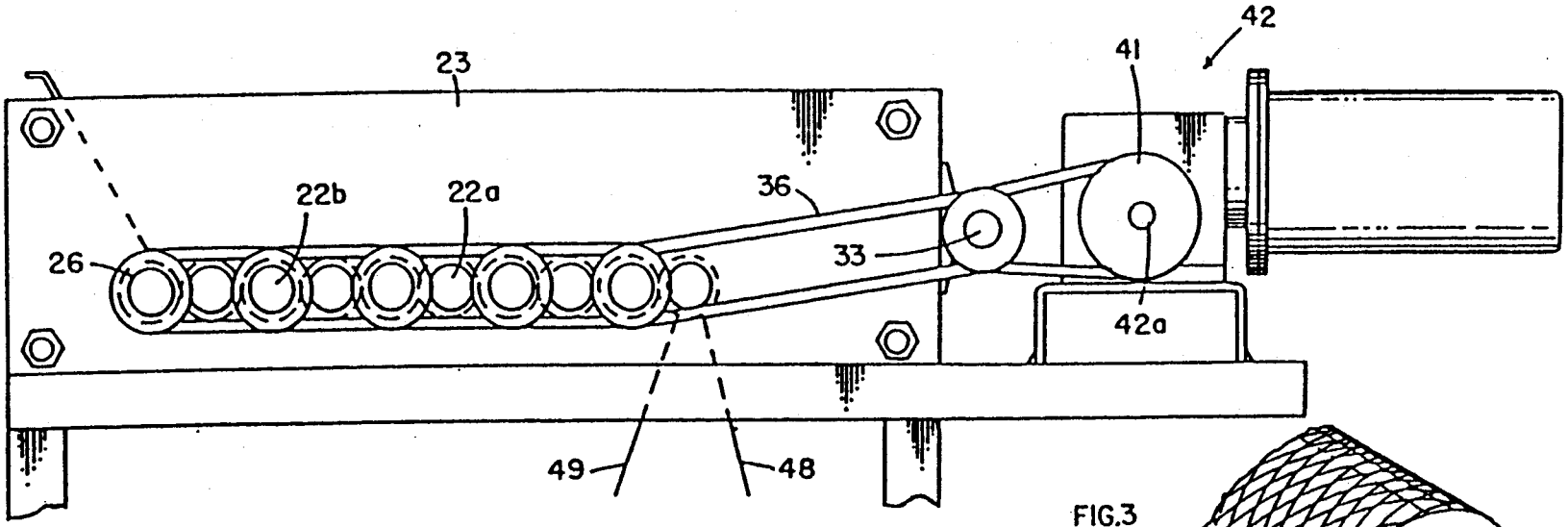
FIG. 2 is a side elevational view of the machine as viewed from the left in FIG. 1 and without a side cover plate.
Figure 4:
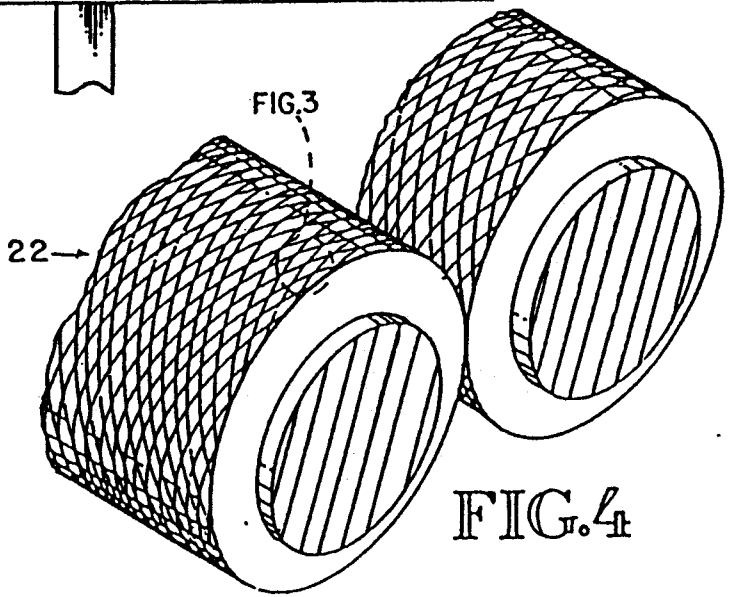
FIG. 4 is a fragmentary perspective view showing end portions of two of the knurled rollers of the first embodiment having pyramidal knurls.

Referring to the drawings, a bed 20 is formed by a plurality of side-by-side, knurled rollers 22 which have parallel rotary axes. These rollers are journal-mounted between upstanding side plates 23, 24 provided as part of a framework 25. The rollers 22 are necked at each end, and the necks 22*a*, 22*b* extend through bearings mounted in the side plates 23, 24. Neck 22*b* of each roller 22 is extended relative to neck 22*a* to receive a single sprocket 26 in the case of the two rearmost rollers and to receive inner and outer sprockets 27, 28 in the case of the other rollers.

It will be noted that alternate of the rollers 22 is reversed endwise so that there are two sets of sprockets, one set being outboard of side plate 23 and the necks 22*a* of the second set, and the second set being outboard of side plate 24 and the necks 22*a* of the first set. At the forward end of the side plates 23, 24, there is mounted a cross-shaft 30, in turn having end sprockets 32, 33 and an intermediate sprocket 34. The end sprockets are connected by chains 36 to the most forward outer sprocket 28 on the respective side of the machine. Alternating inner and outer chains 38, 39 then alternately connect the inner and outer sprockets to drive alternate of the rollers 22 at one side of the machine and to drive the other rollers at the other side of the machine from the shaft 30. The latter is in turn powered by a chain 40 from a drive sprocket 41 on the output shaft 42*a* of a variable-speed drive unit 42 mounted at the front of the framework 25. The described drive arrangement permits rollers with a relatively small diameter, and which are close together, to be used and driven in a simple manner in the same direction of rotation from a single motor.

Figure 6:
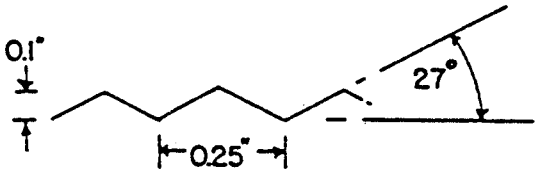
FIG. 6 is a fragmentary view to an enlarged scale showing an example of suitable dimensions for the pyramidal knurls of the first embodiment.

In the preferred embodiment of the present invention, the rollers 22 are preferably provided with knurls 44, each of which has a generally pyramidal shape. These knurls may be formed by routing two sets of V-grooves 45, 46 of opposite hand in crisscrossing spiral paths along the length of the rollers starting from opposite ends. As indicated in FIG. 6, by way of example, each of the V-grooves in each set may have a mouth width of 0.25 inch (6.3 mm) and a depth of 0.10 inch (2.5 mm), and the lead angle on the spiral cuts may be 27 degrees.

Figure 3:
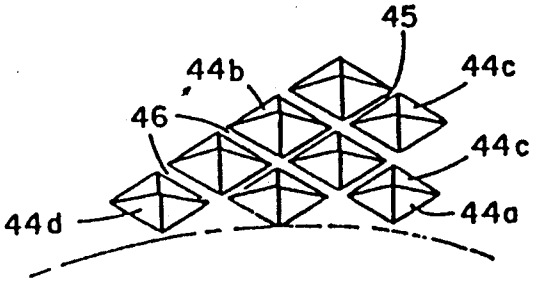
FIG. 3 is a detail view of a first embodiment of rollers taken as indicated in FIG. 4.
Figure 5:
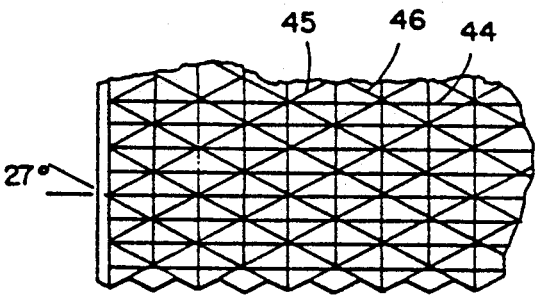
FIGS. 5 is a fragmentary top plan view of one of the knurled rollers of the first embodiment.

Referring to FIG. 3, one of the V-grooves 45 results in the generally triangular, opposed faces 44*a*, 44*b* and one of the V-grooves 46 results in the generally triangular, opposed faces 44*c*, 44*d*. Each of the knurls 44 is hence formed by two adjoining V-grooves 45 and two adjoining V-grooves 46.

It is preferred to chromium plate the rollers 44 to increase the wear life. Also, the rollers can be removed and replated from time to time.

Figure 7:
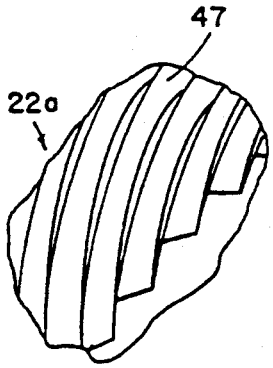
FIGS. 7 and 8 are views taken in similar manner as FIGS. 3 and 4, and showing a second embodiment of rollers with protuberance in ridge form.
Figure 8:
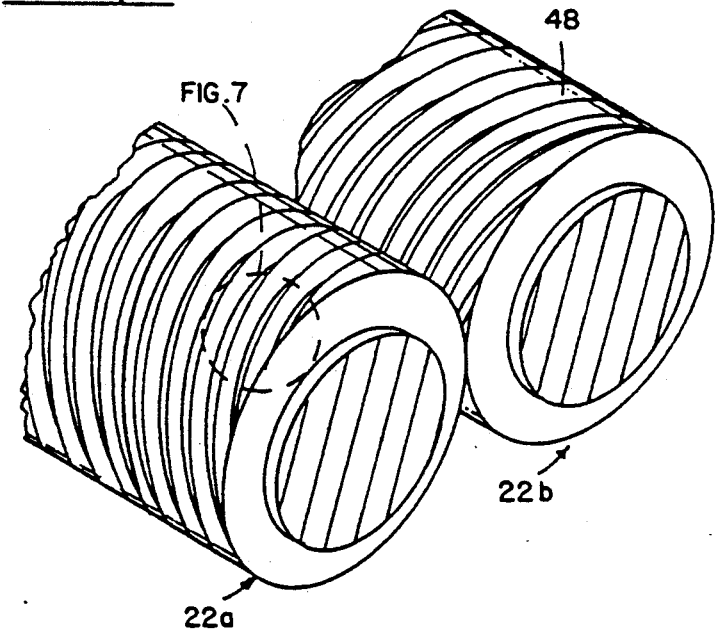

As an alternative to having all of the rollers 22 knurled as above described, some or all of the rollers may be formed with respective spiraling tapered ridges 47 and 48, as shown in FIGS. 7 and 8. These ridges 47 may be formed, for example, by routing only one set of V-grooves 45 or 46 rather than two sets on each roller. Rollers 22*a* may have the spiral of their V-grooves 45 in one direction and rollers 22*b* may have the spiral of their V-grooves 46 of opposite hand. When used on the machine the rollers 22*a* preferably alternate with respect to the rollers 22*b*. Ridged rollers 22*a*, 22*b* can be used for the entire bed, as shown in FIG. 10, or can be alternated with the knurled rollers 22, as indicated in FIG. 8, or in some other suitable pattern. In each instance the protuberances (knurls or ridges) on the rollers are spaced apart between rollers by a gap (see FIG. 11) determining the maximum chip thickness desired which commonly will be 8 mm. This gap has been exaggerated in the drawings for clarity.

Chips being processed are fed into the rear portion of the bed 20 from an overhead hopper or chute (not shown) and are confined by the sidewalls and a sloped rear wall 46. Depending upon which rollers are used, the chips are tumbled by the knurls 44 on the rotating rollers 22 and by the tapered spiraling ridges 47, 48 on the rotating rollers 22*a*, 22*b* and are gradually simultaneously conveyed by the rollers toward the forward end of the bed 20 to discharge therefrom into a hopper or onto a discharge conveyer. When the ridged rollers 22*a*, 22*b* are used, as the chips tumble and move forwardly, the ridges 47, 48 tend to move the chips in a zigzagging travel path because the spirals of the ridges 47, 48 are of opposite hand.

The tumbling chips tend to tilt downwardly in the forward direction as they move between rollers. If the chips are not over-thick they pass between the rollers. Surprisingly, over-thick chips nesting above the gap between two rollers are nudged by advancing chips therebehind sufficiently to cause the upwardly advancing portion of the roller at the front of the gap to move the over-thick chips ahead. Thus, the space above the gap between rollers (the nip) does not become clogged with over-thick chips. Ultimately, the over-thick chips discharge from the front of the bed 20 while the chips within the desired thickness range pass downwardly through the gaps between the rollers into a hopper or onto a suitable conveyor.

Figure 12:
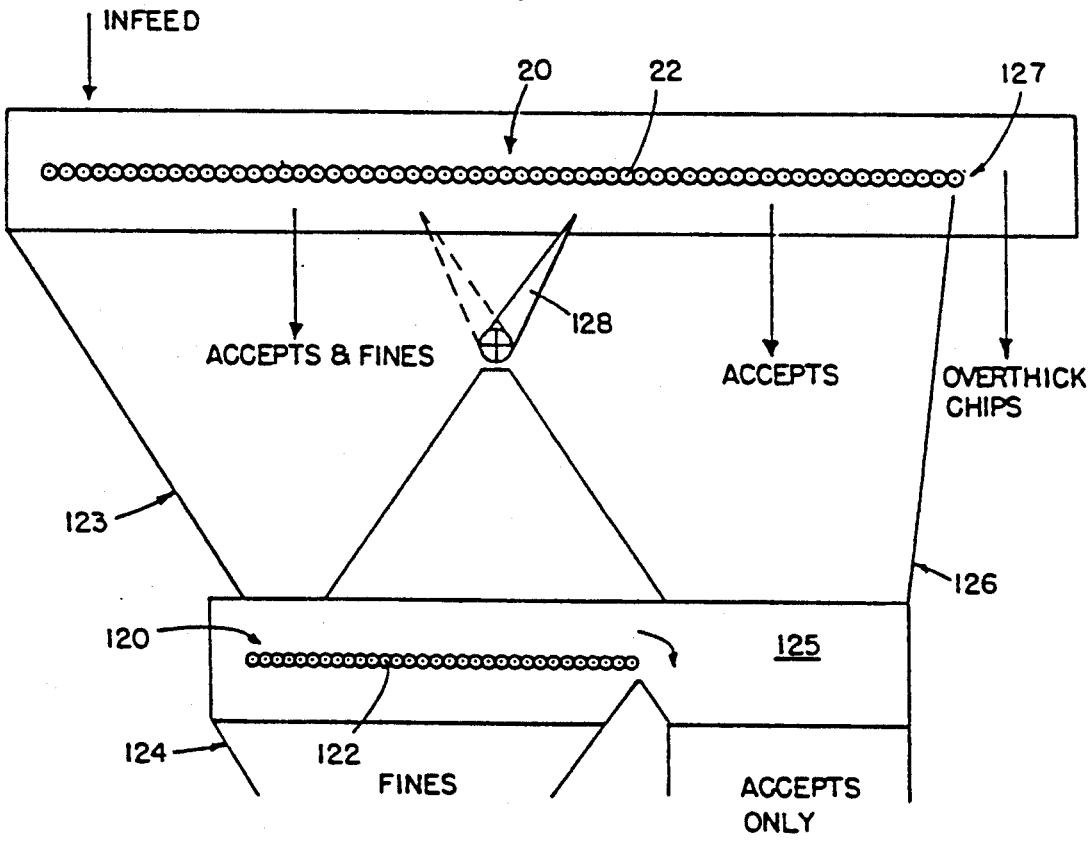
FIG. 12 is a side view illustrating an improved system for removing fines.

In accordance with the present invention, it is preferred to remove fines from the chip material after removing the over-thick chips. As shown in FIG. 12, this can be done efficiently by feeding acceptable chips with fines onto a bed 120 formed with rollers 122, like rollers 22 but of smaller diameter (2.187 inches, for example), and with the pyramidal knurls of adjoining rollers spaced closer together, 0.06 inch, for example, as described in my co-pending application Ser. No. 155,270, filed Feb. 12, 1988. When removing fines, it is preferred to have roller periphery speeds in the range of 50 to 150 feet per minute.

Normally, by the time the chips have traveled about halfway along the length of the bed 20, substantially all of the fines have passed downwardly through the bed, together with acceptable chips. As indicated in FIG. 12, these acceptable chips and the fines drop into a hopper 123, which in turn feeds the infeed end of roller bed 122. This bed 122 screens out the fines, which then drop into a hopper 124, for example, while the acceptable chips continue for the full length of the bed 122 to discharge into a collection zone 125, from which they may be conveyed in a suitable manner for use. Also discharging into the collection zone 125 via a hopper 126 are acceptable chips passing through the second half of the bed 20. The over-thick chips discharge at the outfeed end 127 of the bed 20 for recycling. An adjustable, swing-mounted diverter 128 may be provided between the mouths of the hoppers 123, 126 beneath a central portion of the bed 20 such that the portion of the length of the bed 20 which discharges into the hopper 123 can be adjusted to capture the fines for removal on bed 122 in as short a length of travel along the bed 20 as possible.

For most pulp operations, it is not only desired to reject chips having a thickness in excess of 8 mm, it is also preferred to reject chips having a length in excess of about 1¾ inches ("over-length" chips). In such a case, the rollers 22 are given an outward diameter of about 3½ inches and, namely, about twice the over-length limit. Referring to FIG. 11, when a chip is moving from the first quadrant of a roller toward the fourth quadrant of the next roller with its length extending generally in the direction of travel, the leading end of the chip normally engages the fourth quadrant of the leading of the two rollers before the chip can assume a sufficiently vertical position to drop through the nip between the rollers. This engagement of the leading end of the chip with the leading roller and the continued engagement of the chip with the first quadrant of the trailing roller causes the chip to tilt upwardly at its leading end, as indicated in FIG. 11. The angle of tilt with the horizontal normally must exceed 45 degrees in order for the chip to shift to a substantially vertical position so that it can drop between the rollers. Otherwise, the forward propulsion effect of the fourth quadrant portion of the leading roller is so great that the chip is conveyed forwardly therebeyond. Ultimately, most of the over-length chips discharge with the over-thick chips at the forward end of the roller bed.

When chips are being processed under freezing conditions, the rollers can be engaged on the underside with idler brushes to remove ice particles which may form from moisture on the chips.

The rotational speed of the rollers can be varied for maximum performance, depending upon the density, size and other characteristics of the wood chips being sorted. It is preferred to have roller periphery speeds in the range of about 60 to 120 feet per minute. Although the invention was made for handling wood chips, it will be understood that the invention may be applicable for separating other similar chip materials.

Although it is preferred to use rollers with pyramidal knurls, other tapered shapes can be used. Similarly, the tapered ridges 47, 48 can be varied in slope and lead angle.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A machine for separating over-thick chips having a thickness exceeding a preset thickness limit of about 8 mm from acceptable chips of lesser thickness in a supply of chips containing over-thick chips and acceptable chips, said machine comprising:

a plurality of spaced-apart, side-by-side, parallel rollers collectively providing a bed having its length transverse of said rollers and having infeed and discharge ends;

drive means for rotating said rollers in the same direction of rotation;

means for feeding a supply of chips onto the infeed end of said bed;

the outer surface of each said roller having a plurality of tapered, chip-agitating protuberances separated by valleys which are shallower than said thickness limit and which occupy spiral paths extending around and along the roller, there being spiral paths of opposite hand on adjacent rollers, and the gaps between the protuberances of adjacent said rollers having a width equal to said thickness limit when such protuberances pass one another during rotation of such adjacent rollers, whereby acceptable chips will drop through said gaps and over-thick chips will discharge from said discharge end of the bed.

2. A machine according to claim 1 in which each of said protuberances comprises a tapered spiral ridge extending across the width of said bed.

3. A machine according to claim 1 in which each of said rollers has one set of said spiral paths of one hand and a matching set of said spiral paths of opposite hand whereby said protuberances are pyramidal in shape.

4. A machine according to claim 1 in which said protuberances on some of said rollers comprise tapered spiral ridges extending across the width of said bed, and other rollers of said bed have one set of said spiral paths of one hand and a matching set of said spiral paths of opposite hand, whereby said protuberances on said other rollers are pyramidal in shape.

5. A machine according to claim 4 in which the rollers with spiral ridges alternate with the rollers with pyramidal protuberances.

6. A machine according to claim 1 in which said protuberances are generally V-shaped in cross section.

7. A machine according to claim 1 in which said valleys have a depth of about 2.5 mm.

8. A machine according to claim 7 in which said valleys have a maximum width of about 6 mm.

9. A machine according to claim 1 in which said rollers have a diameter of about 3.5 inches.

10. A machine according to claim 9 in which said drive means is adapted to turn said rollers at a rotational speed in the range of about 60 to 120 rpm.

11. A machine according to claim 1 in which said protuberances are pyramidal in shape and said valleys are narrower than said thickness limit.

12. A machine according to claim 1 in which said protuberances are narrower than said thickness limit.

13. A method of separating over-thick chips having a thickness exceeding a preset thickness limit from wood ship material containing acceptable chips of lesser thickness, said method comprising:

feeding the wood chip material onto a bed formed by a plurality of side-by-side, parallel, coplanar rollers formed with tapered protuberances therealong and spaced part at the outer ends of the protuberances by relatively narrow gaps of a width substantially equal to said thickness limit, said protuberances being defined by continuous grooves which are shaped such that the protuberances do not overhang any portion of said grooves, said grooves having a maximum width which is about the same as the maximum thickness of said protuberances between said grooves; and rotating said rollers in the same direction of rotation such that the material is agitated by said protuberances and conveyed transversely of said rollers so as to cause the acceptable chips to pass downwardly between the rollers and the over-thick chips to discharge from the bed.

14. A method according to claim 13 in which said protuberances are pyramidal and occupy crisscrossing spiral paths around the rollers.

15. A method according to claim 13 in which said protuberances are separated by shallow valleys occupying continuous spiral paths around the rollers.

16. A method according to claim 13 in which said protuberances comprise spiral tapered ridges.

17. A method according to claim 13 in which said thickness limit is about 8 mm.

18. A method of separating over-thick chips from wood chip material containing acceptable chips with an acceptable thickness, said method comprising:

feeding the material onto a roller bed formed by a plurality of side-by-side parallel rollers having a minimum outer radius and a maximum outer radius, said rollers being spaced apart by narrow gaps at their outer radius and each having a surface pattern of tapered protuberances extending from said minimum outer radius to said maximum outer radius and separated by valleys such that acceptable chips, but not over-thick chips, can occupy said valleys and gaps to pass between the rollers and discharge beneath the bed; said valleys having a maximum width about the same as the maximum width of said protuberances between the valleys; and rotating said rollers in the same direction of rotation so that said protuberances tumble and convey said material toward a discharge end of the bed, the acceptable chips in the material occupy said spaces and gaps and pass through the bed and the over-thick chips discharge from said discharge end of the bed.

* * * * *

UNITED STATES PATENT AND TRADEMARK OFFICE

CERTIFICATE OF CORRECTION

PATENT NO. : 5,012,933

DATED : May 7, 1991

INVENTOR(S) : Adrian Artiano

It is certified that error appears in the above-identified patent and that said Letters Patent is hereby corrected as shown below:

In column 6, claim 13, line 53, please delete "ship" and substitute therefor -- chip --.

In column 6, claim 13, line 58, please delete "part" and substitute therefor -- apart --.

Signed and Sealed this

Twenty-second Day of September, 1992

*Attest:*

DOUGLAS B. COMER

*Attesting Officer*

*Acting Commissioner of Patents and Trademarks*